US009818516B2

(12) United States Patent
Li et al.

(10) Patent No.: US 9,818,516 B2
(45) Date of Patent: Nov. 14, 2017

(54) HIGH TEMPERATURE HYBRID PERMANENT MAGNET

(71) Applicant: Ford Global Technologies, LLC, Dearborn, MI (US)

(72) Inventors: Wanfeng Li, Novi, MI (US); C Bing Rong, Canton, MI (US); Leyi Zhu, Novi, MI (US); Feng Liang, Troy, MI (US); Michael W. Degner, Novi, MI (US); Jun Yang, Bloomfield Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 561 days.

(21) Appl. No.: 14/496,612

(22) Filed: Sep. 25, 2014

(65) Prior Publication Data

US 2016/0093425 A1 Mar. 31, 2016

(51) Int. Cl.
*H01F 1/057* (2006.01)
*H01F 41/02* (2006.01)
(Continued)

(52) U.S. Cl.
CPC ..... *H01F 1/0577* (2013.01); *B22F 3/02* (2013.01); *B22F 3/12* (2013.01); *C22C 38/002* (2013.01); *C22C 38/005* (2013.01)

(58) Field of Classification Search
CPC ..... H01F 1/0577; H01F 41/0273; B22F 3/02; B22F 3/12; C22C 38/002; C22C 38/005
(Continued)

(56) References Cited

U.S. PATENT DOCUMENTS

2003/0211000 A1 11/2003 Chandhok
2009/0007417 A1* 1/2009 Yamashita ..... H01F 1/0578 29/608

(Continued)

FOREIGN PATENT DOCUMENTS

WO 2013056185 A1 4/2013

OTHER PUBLICATIONS

Zhang et al., "Magnetic properties and thermal stability of MnBi/SmFeN hybrid bonded magnets", Journal of Applied Physics, vol. 115, pp. 17A746-17A746-3, published online Mar. 11, 2014; 3 pages.*

(Continued)

*Primary Examiner* — Helene Klemanski
(74) *Attorney, Agent, or Firm* — David Kelly; Brooks Kushman P.C.

(57) ABSTRACT

In at least one embodiment, a hybrid permanent magnet is disclosed. The magnet may include a plurality of anisotropic regions of a Nd—Fe—B alloy and a plurality of anisotropic regions of a MnBi alloy. The regions of Nd—Fe—B alloy and MnBi alloy may be substantially homogeneously mixed within the hybrid magnet. The regions of Nd—Fe—B and MnBi may have the same or a similar size. The magnet may be formed by homogeneously mixing anisotropic powders of MnBi and Nd—Fe—B, aligning the powder mixture in a magnetic field, and consolidating the powder mixture to form an anisotropic hybrid magnet. The hybrid magnet may have improved coercivity at elevated temperatures, while still maintaining high magnetization.

17 Claims, 1 Drawing Sheet

(51) Int. Cl.
*B22F 3/02* (2006.01)
*B22F 3/12* (2006.01)
*C22C 38/00* (2006.01)

(58) Field of Classification Search
USPC ..... 419/30, 62; 148/100, 103, 105; 75/246; 252/62.55
See application file for complete search history.

(56) References Cited

U.S. PATENT DOCUMENTS

| | | | | |
|---|---|---|---|---|
| 2011/0210283 | A1 | 9/2011 | Ramirez et al. | |
| 2013/0162089 | A1 | 6/2013 | Komuro et al. | |
| 2014/0072470 | A1 | 3/2014 | Sankar et al. | |
| 2014/0132376 | A1 | 5/2014 | Jin | |
| 2014/0291296 | A1* | 10/2014 | Jin | B23H 1/04 219/69.16 |
| 2016/0168660 | A1* | 6/2016 | Kim | H01F 1/0557 252/62.55 |

OTHER PUBLICATIONS

Cao et al., "Msgnetic properties amd thermal stability of MnBi/NdFeB hybrid bonded magnets", Journal of Applied Physics, vol. 109, No. 7, pp. 07A740-1 to 07A740-3, published online Apr. 11, 2011; 3 pages.*

Rao et al., "Anisotropic MnBi/SM2Fe17Nx Hybrid Magnets Fabricated by Hot Compaction", IEEE Transactions on Magnetics, vol. 49, No. 7, pp. 3255-3257; Jul. 15, 2013; 3 pages.*

Ma et al., "Preparation and magnetic properties of anisotropic bulk MnBi/NdFeB hybrid magnets", Journal of Magnetism and Magnetic Materials, 411, pp. 116-119, Mar. 2016, 4 pages.*

Yang, J.B. et al., "Structure and magnetic properties of the MnBi low temperature phase," Journal of Applied Physics, v. 91, n. 10, May 15, 2002, pp. 7866-7868.

* cited by examiner

HIGH TEMPERATURE HYBRID PERMANENT MAGNET

TECHNICAL FIELD

The present disclosure relates to high temperature hybrid permanent magnets, for example, for use in electric motors.

BACKGROUND

Sintered Neodymium-Iron-Boron (Nd—Fe—B) magnets have the highest energy product among current permanent magnets. However, sintered Nd—Fe—B magnets have a relatively low Curie temperature of about 312° C., which may prevent them from being used in some high temperature applications, such as electric vehicles and wind turbines. Several approaches have been taken to improve the thermal stability of sintered Nd—Fe—B magnets. Alloying is one approach that has been investigated. Cobalt substitution for iron may increase the Curie temperature; however, it may also decrease the anisotropy field and therefore the coercivity of the magnets. Another approach that has been tried is the substitution of Dysprosium (Dy) or Terbium (Tb) for Nd. Addition of these heavy rare earth elements can significantly increase the anisotropy field of the hard magnetic $R_2Fe_{14}B$ (R=rare earth) phase. Although the coercivity of sintered Nd—Fe—B magnets can be effectively increased by such substitution, the antiparallel coupling between these heavy rare earths and the Fe spin moments in Dy—Fe and Tb—Fe leads to a significant decrease in saturation magnetization. In addition, Dy and Tb are much more expensive and much less abundant than Nd.

In addition to alloying, another approach to increasing the thermal stability of Nd—Fe—B magnets is the forming of a hybrid magnet, which is a mixture of different permanent magnets with magnetic properties compensating for each other. For example, one magnet with high magnetization and another with high thermal stability. Due to the dipolar interaction, the thermal resistance of the high magnetization material can be improved by the high thermal stability material. In previous research, Samarium-Cobalt (Sm—Co) alloys have been used as high thermal stability materials, in particular $SmCo_5$ and $Sm_2Co_{17}$, for their much higher Curie temperature compared with $Nd_2Fe_{14}B$.

SUMMARY

In at least one embodiment, a hybrid magnet is provided including a plurality of anisotropic regions of a Nd—Fe—B alloy and a plurality of anisotropic regions of a MnBi alloy. The regions of Nd—Fe—B alloy and MnBi alloy may be substantially homogeneously mixed within the hybrid magnet. In one embodiment, the regions of Nd—Fe—B alloy and MnBi alloy may be substantially the same size, such as between 100 nm to 50 μm.

A ratio of MnBi alloy to Nd—Fe—B alloy in the magnet may be from 40/60 to 60/40 by weight. The regions of MnBi alloy may be low temperature phase (LTP) MnBi and the regions of Nd—Fe—B alloy may include $Nd_2Fe_{14}B$. In one embodiment, the regions of Nd—Fe—B alloy and MnBi alloy are each a single grain. Each of the regions of Nd—Fe—B alloy and MnBi alloy may be magnetically aligned in the same direction. In one embodiment, a surface region of the magnet has increased MnBi alloy content compared to a bulk region of the magnet.

In at least one embodiment, a method of forming a hybrid permanent magnet is provided. The method may include mixing a plurality of anisotropic particles of a Nd—Fe—B alloy and a plurality of anisotropic particles of a MnBi alloy to form a substantially homogeneous magnetic powder, aligning the homogeneous magnetic powder in a magnetic field, and consolidating the homogeneous magnetic powder to form an anisotropic permanent magnet.

In one embodiment, the particles of Nd—Fe—B alloy and the particles of MnBi alloy may be substantially the same size, such as between 100 nm to 50 μm. The mixing step may include mixing the particles of Nd—Fe—B alloy and the particles of MnBi alloy in a ratio of MnBi to Nd—Fe—B from 40/60 to 60/40 by weight. The consolidating step may performed at a temperature of 300° C. or less or may include spark plasma sintering or microwave sintering.

In at least one embodiment, a hybrid magnet is provided including a plurality of anisotropic regions of a Nd—Fe—B alloy and a plurality of anisotropic regions of a MnBi alloy. The regions of Nd—Fe—B alloy and MnBi alloy may have a size ratio of 1:2 to 2:1.

In one embodiment, the regions of Nd—Fe—B alloy and MnBi alloy may each have a size of 100 nm to 50 μm. The regions of Nd—Fe—B alloy and MnBi alloy may be substantially homogeneously mixed within the hybrid magnet. A ratio of MnBi alloy to Nd—Fe—B alloy in the magnet may be from 40/60 to 60/40 by weight. In one embodiment, a surface region of the magnet has increased MnBi alloy content compared to a bulk region of the magnet.

DETAILED DESCRIPTION

Figure 1:
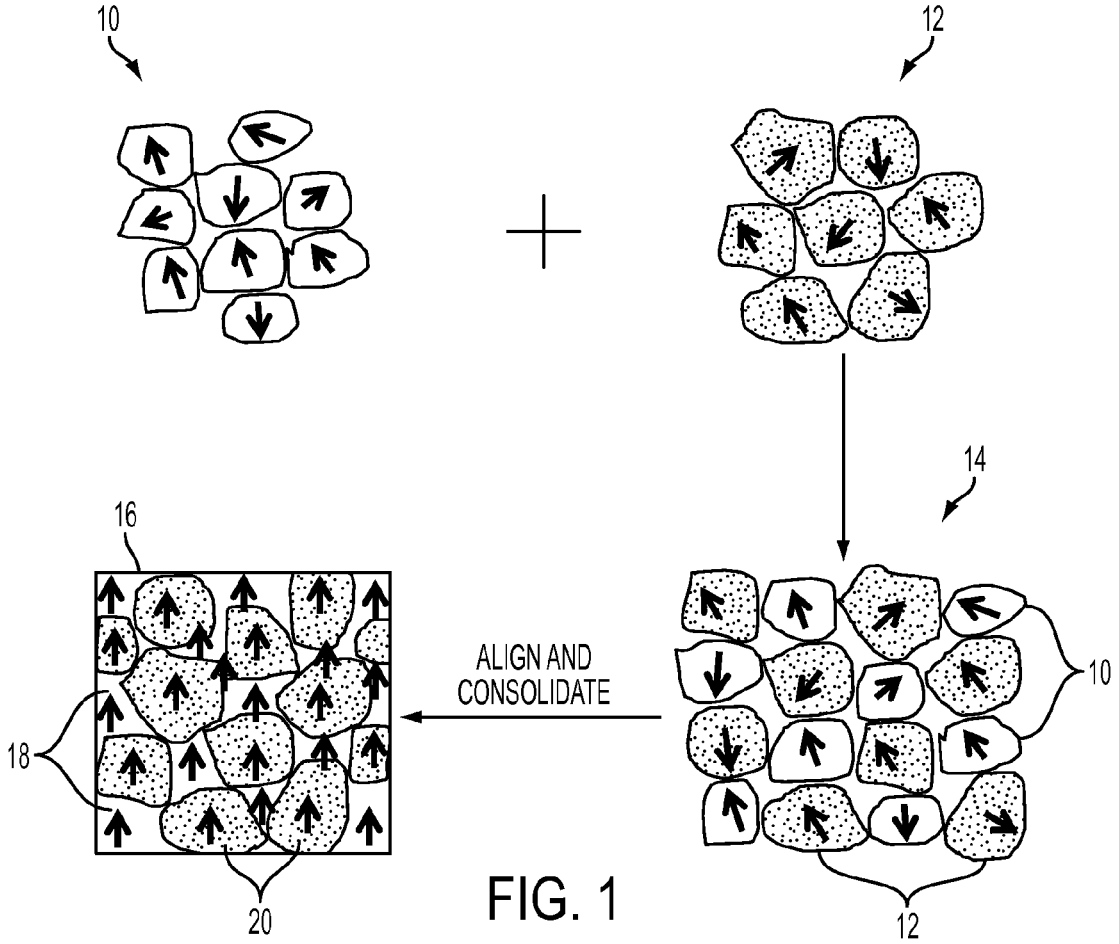
FIG. 1 is a schematic of the process of forming a hybrid permanent magnet, according to an embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As discussed in the Background, Nd—Fe—B and Sm—Co hybrid magnets have been researched as a potential approach to increasing the thermal stability of Nd—Fe—B magnets. However, Nd—Fe—B and Sm—Co hybrid magnets have several drawbacks. It is known that density may affect the energy density and mechanical properties of a magnet. Since both Nd—Fe—B and Sm—Co alloys are mechanically very hard, to get a relatively high density hybrid magnet these alloys need to be sintered or hot pressed at high temperatures (e.g., >700° C.). However, since both Nd—Fe—B and Sm—Co alloys each require their own unique heat treatment process after sintering or hot pressing of the hybrid magnet, it is difficult to find a single heat treatment procedure that fits the demand of both alloys. In addition, inter-diffusion between Nd—Fe—B and Sm—Co alloys may occur during sintering or hot pressing, which may be problematic. Furthermore, despite the fact that both Nd and Sm can form the $R_2Fe_{14}B$ or $R_2Co_{17}$ phases with the same crystal structures, these alloys have unfavorable easy basal plane anisotropy, which can lead to much lower coercivity.

Accordingly, hybrid magnets having different compositions and different processing methods are needed to increase the thermal stability of Nd—Fe—B magnets. In at least one embodiment, a hybrid magnet including Nd—Fe—B and Manganese-Bismuth (MnBi) alloys is provided having increased coercivity at high temperatures. A method of forming a hybrid magnet including Nd—Fe—B and MnBi alloys is also provided.

In at least one embodiment, the MnBi alloy may be in a low temperature phase (LTP). The LTP phase of MnBi is described in "Structure and magnetic properties of the MnBi low temperature phase," Journal of Applied Physics 91, 7866 (2002), which is hereby incorporated in its entirety by reference herein. When in the LTP, MnBi alloys have a positive coercivity temperature coefficient (i.e., the coercivity increases with increasing temperature). For example, at 200° C., the coercivity of MnBi may be up to 27 kOe, compared to about 10 kOe at room temperature (depending on the processing conditions). This positive temperature coefficient is in contrast with other magnetic alloys, such as Sm—Co or Nd—Fe—B, and may allow the hybrid magnet to maintain magnetization at relatively high temperatures. In addition to its positive thermal coefficient, MnBi alloys also have a similar mechanical hardness to easily deformable steels. Accordingly, MnBi alloys may work well as a sort of "glue material" when used in a hybrid magnet. Sm—Co alloys, on the other hand, are mechanically hard and therefore complicate the densification and sintering processes when used in hybrid magnets. To address issues with hard magnetic powders, resin has been used as binder in the past. However, the use of resins both lowers the working temperature of the hybrid magnet and decreases the magnetization of the magnet.

With reference to FIG. 1, a method of forming a hybrid magnet and a hybrid magnet formed therefrom is disclosed. Particles or powder 10 of LTP MnBi may be prepared using any suitable method. In at least one embodiment, a MnBi alloy is prepared and subsequently processed into a powder. The alloy may be prepared using any suitable method. In one embodiment, the alloy is formed using an arc-melting process, followed by an annealing step. The alloy may be prepared by arc-melting raw materials of Mn and Bi to get a bulk alloy for annealing. In another embodiment, the alloy may be prepared by melt spinning. In this approach, either a mixture of pure Mn and pure Bi or a MnBi alloy (e.g., prepared from arc melting) can be melted and rapidly solidified in a melt spinner to get a MnBi magnet. This method may result in a magnet with a small grain size. For example, the grain size may be 10 nm or less, or even amorphous. The grain size may be altered by a subsequent heat treatment, such as an annealing step. If the alloy is amorphous, it may be crystallized in a subsequent heat treatment.

The MnBi alloy may have any suitable composition, for example, the Mn content may be from 40 at. % to 60 at. %, with the balance Bi. The annealing step may include a heat treatment at a temperature of 150° C. to 360° C., or any sub-range therein, such as 250° C. to 355° C. or 275° C. to 325° C. In one embodiment, the annealing step is performed at about 300° C. The annealing heat treatment may also be a multi-step process with one or more heat treatment steps within the temperature range. The annealing heat treatment may be performed for a time suitable to form the LTP phase of MnBi. The annealing time may vary depending on factors such as the annealing temperature, the MnBi alloy composition, the size/shape of the MnBi alloy, or others. In one embodiment, the annealing time may be at least 1 hour. In another embodiment, the annealing time may be at least 10 hours. In another embodiment, the annealing time may be at least 25 hours. In another embodiment, the annealing time may be 10 to 30 hours, or any sub-range or value therein, such as 10, 15, 20, 25, or 30 hours.

After the MnBi alloy has been prepared (e.g., from arc-melting or melt spinning), it may be processed into particles or powder 10 using any suitable method. In one embodiment, cryo-milling may be performed, wherein the alloy is milled in liquid nitrogen or other low temperature media. The low temperature increases the brittleness of the MnBi alloy and causes the alloy to break into fine powders and increase or maintain anisotropy. Another potential method of producing a powder 10 is low energy milling.

In another embodiment, a mechanochemical method may be used to form the MnBi powder. In the mechanochemical method, oxides of Mn and Bi may be mixed in a ratio of about one and high energy ball milling is performed. During the milling, a reducing agent, such as calcium, is introduced and reduces the oxides to metals. As a result of the mechanochemical process, single crystal, nano-sized MnBi powders may be produced that are anisotropic.

Regardless of the processing method to form the powder 10, in at least one embodiment, the MnBi powder is anisotropic. The particles in the powder may be single crystals or may be polycrystalline with the grains having substantially the same orientation. In addition, the particle size of the powder 10 may be relatively small in order to increase anisotropy and increase the interaction between the MnBi powder and the Nd—Fe—B powder. Magnetic interaction is distance dependent, therefore, the shorter the distance between the particles, the stronger the interaction. Accordingly, smaller particle sizes and a more uniform distribution of the powder phases may result in a stronger interaction between them. In one embodiment, the MnBi powder 10 may have a mean particle size of 50 μm or less. In another embodiment, the MnBi powder 10 may have a mean particle size of 25 μm or less. In another embodiment, the MnBi powder 10 may have a mean particle size of 10 μm or less, such as from 100 nm to 10 μm.

Particles or powder 12 of Nd—Fe—B may be prepared using any suitable method. The Nd—Fe—B powder may include any suitable rare-earth magnet composition, such as $Nd_2Fe_{14}B$ powder. In at least one embodiment, the Nd—Fe—B alloy is prepared using a hydrogenation disproportionation desorption and recombination (HDDR) process. The HDDR process is known to one of ordinary skill in the art and will not be explained in detail. In general, the HDDR process includes a series of heat treatments in a hydrogen atmosphere and under vacuum. During the process, a bulk Nd—Fe—B alloy, such as $Nd_2Fe_{14}B$, is heated in a hydrogen atmosphere to perform the hydrogenation process. During the disproportionation step, the alloy segregates into $NdH_2$, Fe, and $Fe_2B$ phases. Once a vacuum atmosphere is introduced, the desorption of hydrogen occurs and then, in the recombination step, the $Nd_2Fe_{14}B$ phase is reformed, normally with a finer grain size than the alloy started with. In at least one embodiment, the grain size (e.g., mean grain size) of the powder 12 is from 100 to 500 nm, or any sub-range therein. For example, the grain size may be from 150 to 450 nm or 200 to 400 nm. By controlling the processing parameters of the HDDR process, such as the partial pressure of hydrogen, anisotropic Nd—Fe—B powders can be produced. Anisotropic powders can significantly increase the remanence, and therefore the energy product, of the resulting magnets.

The powder 12 may have any suitable particle size, however, smaller particle sizes may increase the anisotropy of the hybrid magnet and enhance the interaction between the two different powders (MnBi powder 10 and Nd—Fe—B powder 12). Pulverization techniques may be used to reduce the particle size of the powder 12. In one embodiment, jet milling is used to reduce the particle size. Jet milling includes the use of compressed air or other gases to cause particles to impact one another, thereby splitting into smaller and smaller particles. Jet milling may also narrow the size distribution of the powder 12, in addition to reducing the particle size. To avoid oxidation, the pulverization technique (e.g., jet milling) may be performed in a protective gas environment, such as nitrogen or an inert gas.

The MnBi powder 10 and the Nd—Fe—B powder 12 may each have any suitable particle size (e.g., mean particle size). In one embodiment, the MnBi powder 10 and the Nd—Fe—B powder 12 may have the same or substantially the same particle size (e.g., an average particle size within about 10% of each other). In one embodiment, the powders 10 and 12 may have a particle size ratio of 4:1 to 1:4 (e.g., based on mean particle size). For example, the particle size ratio may be from 3:1 to 1:3, 2:1 to 1:2, or from 3:2 to 2:3. Accordingly, if both powders had a mean particle size of 500 nm, the ratio would be 1:1, if one had a mean particle size of 500 nm and the other was 1 μm, the ratio would be 1:2, and if one had a mean particle size of 750 nm and the other was 500 nm, the ratio would be 3:2. In one embodiment, the MnBi powder 10 and/or the Nd—Fe—B powder 12 have a mean particle size of 100 nm to 100 μm. In another embodiment, the MnBi powder 10 and/or the Nd—Fe—B powder 12 have a mean particle size of 100 nm to 50 μm. In another embodiment, the MnBi powder 10 and/or the Nd—Fe—B powder 12 have a mean particle size of 100 nm to 25 μm. In another embodiment, the MnBi powder 10 and/or the Nd—Fe—B powder 12 have a mean particle size of 100 nm to 10 μm. In another embodiment, the MnBi powder 10 and/or the Nd—Fe—B powder 12 have a mean particle size of up to 10 μm.

With reference again to FIG. 1, the MnBi powder 10 and the Nd—Fe—B powder 12 may be mixed together to form a magnetic powder mixture 14. As described above, the mixture 14 may have a homogeneous or substantially homogeneous particle size and size distribution. In at least one embodiment, the powder mixture 14 is a homogeneous or substantially homogeneous mixture or has a uniform distribution, such that MnBi powder 10 and the Nd—Fe—B powder 12 are evenly dispersed and lack local order or pattern. Mixing may be performed using any suitable method, such as using a powder mixer or low energy ball milling.

The composition of the powder mixture 14 may vary based on the properties required for the magnet application. In general, increasing the MnBi content in the magnet increases the high temperature stability. However, increased MnBi content may decrease the magnetization of the magnet. In contrast, increasing the Nd—Fe—B content of the magnet may increase the magnetization of the magnet, but reduce the thermal stability. The composition of the powder mixture 14 may include at least 30 wt. % of MnBi powder 10. In at least one embodiment, the powder mixture 14 includes at least 40 wt. % of MnBi powder 10. In another embodiment, the powder mixture 14 includes at least 45%, 50%, 55%, or 60% by weight of MnBi powder 10. In addition, the composition of the powder mixture 14 may include at least 30% by weight of Nd—Fe—B powder 10. In at least one embodiment, the powder mixture 14 includes at least 40 wt. % of Nd—Fe—B powder 10. In another embodiment, the powder mixture 14 includes at least 45%, 50%, 55%, or 60% by weight of Nd—Fe—B powder 10. In the above mixtures, when the MnBi content is described, the balance may be Nd—Fe—B, and vice versa. In one embodiment, the ratio of MnBi powder 10 to Nd—Fe—B powder 12 in the mixture 14 may be from 30/70 to 70/30 by weight, or any sub-range therein. For example, the ratio of MnBi powder 10 to Nd—Fe—B powder 12 in the mixture 14 may be from 40/60 to 60/40 or 45/55 to 55/45. In one embodiment, the ratio of MnBi powder 10 to Nd—Fe—B powder 12 is about 55/45 by weight. While the above percentages/ratios are described in terms of weight, the density of Nd—Fe—B and MnBi magnets are similar (~7.6 g/cm$^3$ and ~8.4 g/cm$^3$ for Nd—Fe—B and MnBi, respectively), therefore, the same ranges for the composition may also be applicable based on volume percent.

Once the powder mixture 14 is prepared and mixed (e.g., homogeneously), it may be consolidated into a bulk hybrid magnet 16. Prior to and/or during consolidation, the powder mixture may be aligned using a magnetic field. Consolidation may be performed using any suitable method. In one embodiment, the powder mixture 14 may be pressed at a relatively low temperature, such as below 300° C., in order to maintain the MnBi in the low temperature phase (LTP). Due to the relatively low hardness of the LTP phase, high compaction density is attainable despite the low temperature. In another embodiment, the powder mixture 14 may be pressed and/or sintered at a high temperature for a short duration. Examples of suitable rapid, high temperature pressing or sintering processes include spark plasma sintering (SPS) and microwave sintering. Due to the rapid nature of these sintering processes, the transition of the LTP MnBi to less desirable high temperature phases may be prevented or mitigated.

The consolidated bulk hybrid magnet 16 may have a microstructure that corresponds to the powder mixture 14 prior to consolidation. Accordingly, a homogeneously mixed powder 14 may result in a magnet 16 having homogeneously mixed regions 18 and 20 of MnBi and Nd—Fe—B, respectively. A magnet formed from the homogeneously mixed powder may therefore have homogeneously mixed regions of MnBi and Nd—Fe—B across or throughout the entire magnet. As described above, homogeneously mixed may mean that the regions are uniformly or evenly dispersed and/or that there is no local order or pattern to the regions. The regions 20 of Nd—Fe—B may include $Nd_2Fe_{14}B$. For example, the regions 20 may be formed mostly (e.g., more than 50 vol. %) of $Nd_2Fe_{14}B$ or may be at least 70%, 80%, 90%, or more $Nd_2Fe_{14}B$ by volume. In one embodiment, the regions 20 may be substantially all $Nd_2Fe_{14}B$. During processing, other minor phases may be formed, such as an Nd-rich phase, which may form the balance of the regions 20. The size of the resulting regions of MnBi and Nd—Fe—B may be the same or similar to the size of the powders 10 and 12. In at least one embodiment, the regions 18 and 20 may be the same or substantially the same size (e.g., mean sizes within 10% of each other). The regions 18 and 20 may also have the same or similar sizes to the powders 10 and 12, described above, as well as the disclosed relative size ratios. If the powders 10 and/or 12 were a single grain, the corresponding regions in the consolidated magnet 16 may also be a single grain. Similarly, the alignment of the powders 10 and 12 before and/or during consolidation may be preserved in the consolidated magnet 16.

As described above, magnetic interaction is distance dependent. Therefore, the shorter the distance between the particles or regions, the stronger the interaction. Accordingly, smaller particle sizes/regions and a more uniform or homogeneous distribution and/or size distribution of the phases may result in a stronger interaction between them. This interaction allows the hybrid magnet to have a higher coercivity at elevated temperatures (due to the MnBi), while retaining high magnetization (due to the Nd—Fe—B).

After the powder mixture 14 is consolidated into a bulk hybrid magnet 16, an additional annealing step may be performed to further improve the properties. The annealing heat treatment may be performed at a temperature below 300° C., which is the approximate phase transition temperature of the MnBi LTP phase. Accordingly, during the annealing process, any high-temperature phase may be converted to the LTP. The annealing process may have a duration that allows for complete or substantially complete formation of LTP in the magnet. Non-limiting examples of an annealing heat treatment may include heating the magnet 16 to a temperature of 200° C. to 250° C. for 1 to 20 hours, or any sub-range therein. For example, the heat treatment may last for 2 to 4 hours, 2 to 10 hours, 10 to 20 hours, or other ranges. Since the annealing temperature is below the phase transition temperatures of all the phases in the Nd—Fe—B portions of the magnet, those portions will be relatively unaffected by the annealing heat treatment.

The disclosed hybrid permanent magnets have multiple advantages compared to previous attempts at producing high temperature permanent magnets. First, the disclosed magnets have significantly increased coercivity at high temperatures, thereby lowering the possibility of magnet demagnetization in high-temperature applications such as vehicle motors and wind turbines. Second, the MnBi LTP allows the hybrid magnets to have a high density using a low temperature compaction or a rapid high temperature sintering or pressing process. The LTP also acts as a glue, which may replace the use of low-temperature resins, while also increasing the magnetization of the hybrid magnet. Accordingly, in at least one embodiment, the magnet 16 does not include any resin or bonding agents. The magnet 16 may be formed of all magnetic materials. In addition, the disclosed magnets do not require heavy rare earth (HRE) elements, such as Dy and Tb. These HRE elements are very expensive compared to the components of the disclosed magnets, therefore significant costs savings can be achieved with the disclosed hybrid magnets. HRE elements are also in low supply and are geographically concentrated such that their acquisition can be subject to business and political risks. However, the addition of HRE elements is not precluded from the disclosed hybrid magnets, and may be included.

Figure 2A:
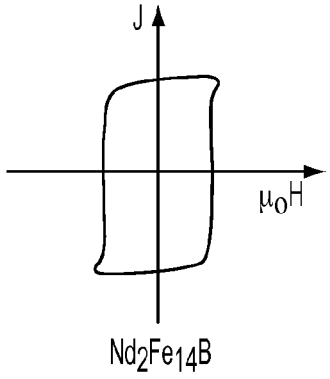
FIGS. 2A-2C are schematic hysteresis loops for a $Nd_2Fe_{14}B$ magnet, MnBi magnet, and the disclosed hybrid magnet.
Figure 2B:
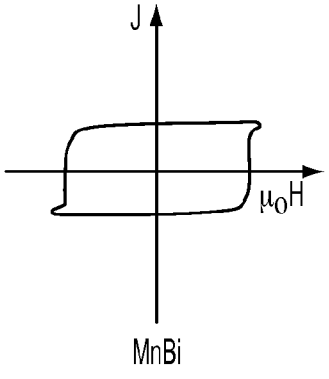
Figure 2C:
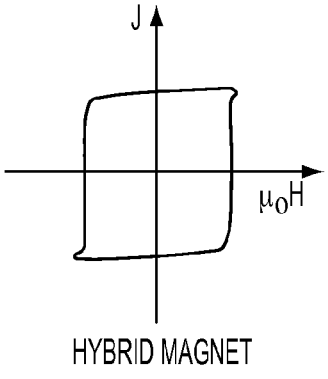

With reference to FIG. 2, schematic hysteresis loops are shown of $Nd_2Fe_{14}B$ (FIG. 2A), MnBi (FIG. 2B), and a hybrid Nd—Fe—B and MnBi magnet (FIG. 2C). As shown, the hybrid magnet combines the advantages of the high magnetization of $Nd_2Fe_{14}B$ and the high coercivity and thermal stability of MnBi. The coercivity of magnets is a function of temperature. For Nd—Fe—B magnets (FIG. 2A), the temperature coefficient is negative. Therefore, at elevated temperatures, the hysteresis loop is "thin," meaning lower coercivity, but higher remanence or magnetization. With increasing temperature, coercivity of the Nd—Fe—B magnets decreases, which makes the magnets more easily demagnetized. In contrast, MnBi magnets (FIG. 2B) have a positive temperature coefficient, meaning they have a higher coercivity with increasing temperature. Therefore, at elevated temperatures, the hysteresis loop is a "fat," meaning higher coercivity, but lower remanence or magnetization. When Nd—Fe—B powders/regions are homogeneously mixed with MnBi powders/regions (FIG. 2C), the higher coercivity of the latter at higher temperature can help increase the coercivity of the mixture through the interaction between these two phases. In addition, due to the interaction, the remanence of the hybrid magnet is increased compared to a pure MnBi magnet, forming a much higher energy product.

Accordingly, the resultant hybrid magnet has improved thermal stability, compared to Nd—Fe—B magnets. In addition, compared with pure MnBi magnets, the hybrid magnet has improved remanence or magnetization due to the contribution from the Nd—Fe—B phases. It is therefore possible to tailor the properties of the hybrid magnet to a specific application. For example, if high-temperature performance or coercivity is the primary consideration, the MnBi content of the hybrid magnet can be increased relative to the Nd—Fe—B. Alternatively, if remanence or magnetization are the more important properties, the Nd—Fe—B content of the hybrid magnet can be increased relative to the MnBi.

In addition, the MnBi and/or Nd—Fe—B content or distribution within the magnet may be adjusted based on the properties required for certain applications. If an application required higher coercivity in a particular region within the magnet, the MnBi content may be increased in that region. Similarly, if an application required higher remanence or magnetization in a particular region within the magnet, the Nd—Fe—B content may be increased in that region. For example, in a motor application, the permanent magnet may require higher coercivity at the surface or surface region of the magnet. To provide the hybrid magnet with increased coercivity at or near the surface, the MnBi content in the surface region may be increased compared to the center or bulk of the magnet. The MnBi and Nd—Fe—B powders (and resulting regions) may still be homogeneously mixed in the region having an adjusted composition. Alternatively, if a portion or region of the magnet does not require high coercivity or magnetization, the content of MnBi or Nd—Fe—B may be lowered, respectively.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A hybrid magnet comprising:

a plurality of anisotropic regions of a Nd—Fe—B alloy; and a plurality of anisotropic regions of a MnBi alloy;

the regions of Nd—Fe—B alloy and MnBi alloy being substantially the same size and substantially homogeneously mixed within the hybrid magnet.

2. The magnet of claim 1, wherein the regions of Nd—Fe—B alloy and MnBi alloy each have a size of 100 nm to 50 μm.

3. The magnet of claim 1, wherein a ratio of MnBi alloy to Nd—Fe—B alloy in the magnet is from 40/60 to 60/40 by weight.

4. The magnet of claim 1, wherein the regions of MnBi alloy are low temperature phase (LTP) MnBi.

5. The magnet of claim 1, wherein the regions of Nd—Fe—B alloy include $Nd_2Fe_{14}B$.

6. The magnet of claim 1, wherein the regions of Nd—Fe—B alloy and MnBi alloy are each a single grain.

7. The magnet of claim 1, wherein each of the regions of Nd—Fe—B alloy and MnBi alloy are magnetically aligned in the same direction.

8. The magnet of claim 1, wherein a surface region of the magnet has increased MnBi alloy content compared to a bulk region of the magnet.

9. A method of forming a hybrid permanent magnet, comprising:

mixing a plurality of anisotropic particles of a Nd—Fe—B alloy and a plurality of anisotropic particles of a MnBi alloy having substantially the same size as the NdFeB alloy particles to form a substantially homogeneous magnetic powder;

aligning the homogeneous magnetic powder in a magnetic field; and consolidating the homogeneous magnetic powder to form an anisotropic permanent magnet.

10. The method of claim 9, wherein the particles of Nd—Fe—B alloy and the particles of MnBi alloy have a size from 100 nm to 50 μm.

11. The method of claim 9, wherein the mixing step includes mixing the particles of Nd—Fe—B alloy and the particles of MnBi alloy in a ratio of MnBi to Nd—Fe—B from 40/60 to 60/40 by weight.

12. The method of claim 9, wherein the consolidating step is performed at a temperature of 300° C. or less.

13. The method of claim 9, wherein the consolidating step includes spark plasma sintering or microwave sintering.

14. A hybrid magnet comprising:

a plurality of anisotropic regions of a Nd—Fe—B alloy; and a plurality of anisotropic regions of a MnBi alloy;

the regions of Nd—Fe—B alloy and MnBi alloy having a size ratio of 1:2 to 2:1, and each independently having a size of 100 nm to 50 μm.

15. The magnet of claim 14, wherein the regions of Nd—Fe—B alloy and MnBi alloy are substantially homogeneously mixed within the hybrid magnet.

16. The magnet of claim 14, wherein a ratio of MnBi alloy to Nd—Fe—B alloy in the magnet is from 40/60 to 60/40 by weight.

17. The magnet of claim 14, wherein a surface region of the magnet has increased MnBi alloy content compared to a bulk region of the magnet.

* * * * *